United States Patent [19]

Litz

[11] 3,973,532

[45] Aug. 10, 1976

[54] CRANKCASE-SCAVENGED FOUR STROKE ENGINE

[76] Inventor: Harold Litz, 2285 N. 7th St., North St. Paul, Minn. 55109

[22] Filed: Oct. 30, 1974

[21] Appl. No.: 511,489

Related U.S. Application Data

[63] Continuation-in-part of Ser. No. 414,396, Nov. 9, 1973, abandoned.

[52] U.S. Cl. ..... 123/75 CC; 184/6.5; 184/6.8; 123/75 RC

[51] Int. Cl.[2] ..... F01L 9/02

[58] Field of Search .. 123/75 CC, 197 AC, 197 AB; 184/6.5, 6.8

[56] References Cited

UNITED STATES PATENTS

| | | | |
|---|---|---|---|
| 931,976 | 8/1909 | Turner | 123/75 CC |
| 1,584,897 | 5/1926 | Skinner et al. | 184/6.8 |
| 2,232,170 | 2/1941 | Eynon | 184/6.5 |
| 2,409,057 | 10/1946 | Meinke | 184/6.8 |
| 3,056,638 | 10/1962 | Hovde | 184/6.5 |
| 3,672,172 | 6/1972 | Hammond | 123/75 CC |

*Primary Examiner*—Wendell E. Burns
*Assistant Examiner*—David D. Reynolds

[57] ABSTRACT

An internal combustion, reciprocating-piston engine which includes a sealed crankcase for inducting and compressing air or an air-fuel mixture into the engine. The compressed gas is then forced into a holding tank for subsequent induction into the cylinder combustion chamber. This pre-compresses or "supercharges" the fuel mixture before compression by the piston. An enclosed lift tube within the connecting rod is provided for conveying lubricating oil through the crankcase to the cylinder walls.

3 Claims, 10 Drawing Figures

CRANKCASE-SCAVENGED FOUR STROKE ENGINE

CONTINUATION-IN-PART APPLICATION

The present application is a continuation-in-part of a copending patent application filed pro se by Mr. Harold Litz on Nov. 9, 1973, and assigned Ser. No. 414,396, now abandoned.

BACKGROUND OF THE INVENTION

1. Field of the Invention

An internal combustion engine utilizing a reciprocating piston and a super-charger device for pre-compressing the fuel mixture prior to induction into the combustion chamber.

2. Description of the Prior Art

The Applicant is presently aware of prior patents which are enumerated in the "Disclosure of Known Art" attached to this patent application. The Applicant became aware of these patents after having prepared and filed the parent application identified by Ser. No. 414,396, filed Nov. 9, 1973.

Internal combustion engines which utilize a reciprocating piston in a cylinder and burn a mixture of fuel and air to produce power have long been known. Such engines are generally used to turn a crankshaft which is contained in a crankcase located adjacent the piston. Internal combustion engines operate by adding fuel to combustion air, drawing the air-fuel mixture into the combustion chamber of the cylinder on the induction stroke of the piston, compressing the fuel mixture during the compression stroke, driving the piston downwardly as the compressed fuel-air mixture is ignited during the power stroke and forcing the spent combustion products out of the combustion chamber during the exhaust stroke. This power cycle is repeated continuously to impart a reciprocating motion to the piston. This reciprocating motion of the piston is transmitted through a connecting rod to a crankshaft.

The power which is delivered by the four-stroke internal combustion engine is directly dependent upon the combustion of the fuel in the combustion chamber. Such factors as the octane of the fuel, the temperature of the fuel and the amount of fuel present in the combustion chamber during ignition of the fuel-air mixture partially determine how much explosive thrust is imparted to the piston by the burning fuel. In conventional engines of this type, the fuel mixture which is drawn into the cylinder on the induction stroke of the piston, generally enters the combustion chamber at atmospheric pressure and temperature. Further, the amount of fuel mixture which is drawn in during the induction stroke is limited by the length of time which is available during which the piston moves from one end of its induction stroke to the other. Thus, the atmospheric temperature of the fuel mixture, the lack of high pressure to help propel the fuel mixture into the combustion chamber on the intake stroke, and the limited amount of time during which the fuel mixture can be inducted all tend to limit the amount, temperature and pressure of the fuel mixture in the combustion chamber during the power stroke. These factors then tend to limit the power output of the engine.

Presently available internal combustion engines generally utilize either an oil pump, wherein oil is pumped to the connecting rod bearings and splashed to the cylinder walls and wrist pin and other moving parts, or a splash system for lubricating the engine cylinders during running of the engine. In the splash type system, the oil is carried in the crankcase where it is splashed up to the cylinder wall to lubricate the moving pistons and other moving parts. Thus, the lubricating oils are exposed to the conditions of heat and pressure which are experienced in the crankcase as the engine is running.

SUMMARY

The present invention is a four stroke internal combustion engine which utilizes a crankcase scavenging device for precompressing and preheating air prior to its induction into the engine combustion chamber. The combustion air is drawn into the crankcase through a one-way valve on the compression and exhaust stroke of the engine. This combustion air also helps cool the interior of the engine. During the induction and power stroke of the engine, the piston compresses this inducted air in the crankcase and forces it into a holding chamber. The compressed air in the holding chamber is subsequently inducted into the combustion chamber of the engine cylinder. Because the combustion air has been precompressed in the crankcase, it moves into the combustion chamber at a more rapid rate and at a higher pressure allowing a greater amount of combustion air and fuel mixture to be present in the combustion chamber. This provides more fuel for the ignition process and provides more force to the piston on the power stroke. As a result, more power is delivered than if the crankcase scavenging feature were not present.

Because the crankcase is utilized as a compression chamber, the present invention provides a flywheel on each side of the connecting rod. These flywheels are also part of the crankshaft and will hereinafter be referred to as the "crankshafts". The crankcase has the same contour as the crankshaft to provide a sealed periphery for the crankcase compression chamber. In addition, the bottom surface of the piston is contoured to more closely fit against the crankshaft thereby decreasing the volume of the crankcase compression chamber and increasing the pressure which is imparted to the inducted air. An oil distribution system is provided for lubricating the piston. This system incorporates an enclosed lift tube or tubes extending along the connecting rod which is attached between the piston and the crankshaft. The life tube allows the oil to be distributed through a channel system within the piston to the periphery of the piston.

One-way valves are used to regulate the induction and exhaust of combustion gas into and out of the crankcase compression chamber. This use of simple valve devices reduces the likelihood of mechanical failure and simplifies the design. Further, a holding tank is utilized for receiving the compressed combustion gas prior to its induction into the combustion chamber. This provides a ready reserve of compressed combustion air for instantaneous induction into the combustion chamber. A throttle valve is provided between the holding chamber and the combustion chamber to provide quick control to the running of the engine by controlling the flow of combustible mixture of fuel and air or oxygen from the holding chamber to the combustion chamber.

DETAILED DESCRIPTION OF THE PREFERRED EMBODIMENT

Figure 1:
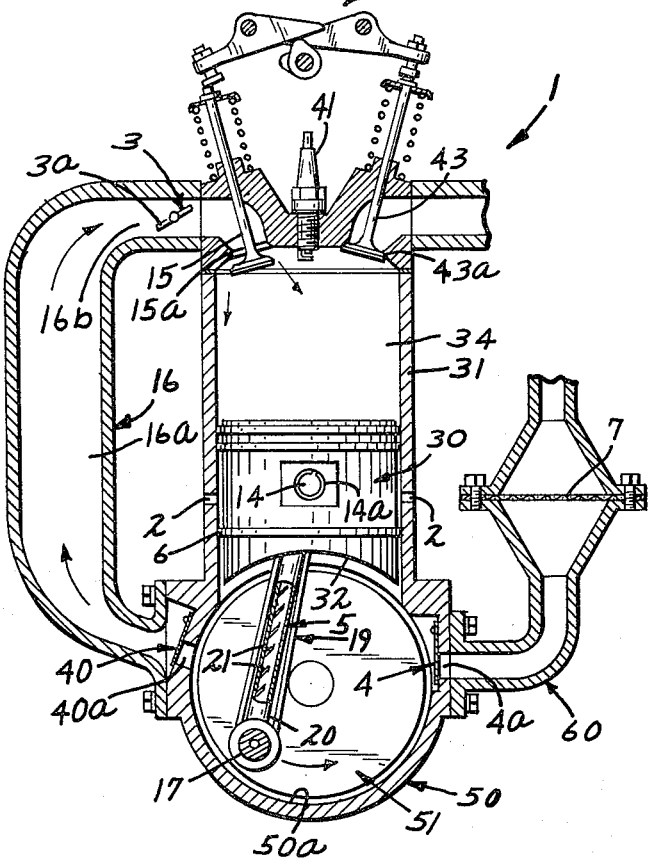
FIG. 1 is a side sectional view of the engine showing the piston near the end of the induction stroke.
Figure 2:
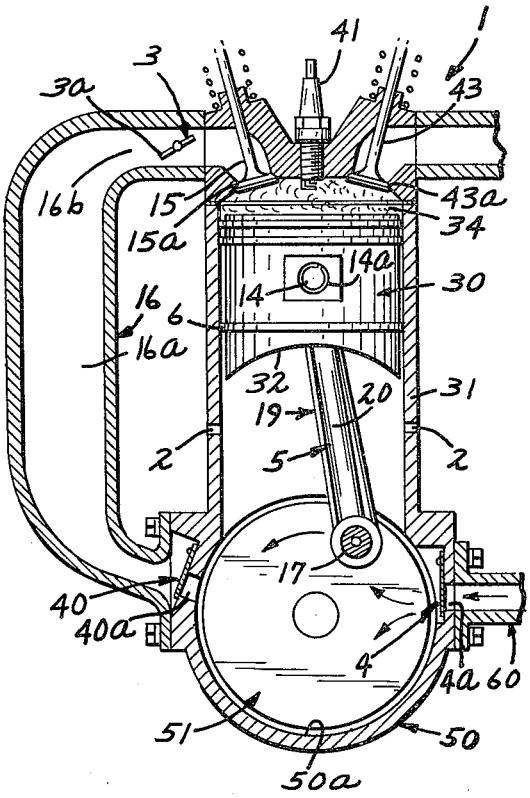
FIG. 2 is a side sectional view of the engine showing the piston during the compression stroke.

Referring to FIGS. 1–10 wherein like numerals refer to like structural elements, the present invention comprises a reciprocating piston 30 which moves in a cylinder 31 to drive a crankshaft 18. A sealed crankcase 50 is utilized in combination with a holding tank 16 to provide precompression means to supercharge the engine 1. Lubricating means 5 are provided in a connecting rod 19 as a preferred embodiment for lubricating the wrist pin and peripheral surface of piston 30. Throttle valve apparatus 3 is provided for purposes of regulating the flow of supercharged gas from the holding tank 16 to an engine combustion chamber 34.

In the preferred embodiment of the present invention, the crankcase scavenged engine apparatus 1 provides power to the crankshaft 51 by movement of piston 30 in a four-stroke cycle. Piston 30 is connected to crankshaft 51 by means of a connecting rod 19 connected to crankshaft 51 by means of bearings 17. FIG. 1 shows the induction stroke, FIG. 2 the compression stroke, FIG. 3 the power stroke and FIG. 4 the exhaust stroke. While FIGS. 1–4 show a single piston apparatus, the present invention may pertain to an engine having any number of such pistons, each having the design described herein and each interconnected with the other by means of the crankshaft for synchronized operation.

To increase the power which is delivered by the engine on the power stroke, supercharging or "scavenging" apparatus are provided to precompress the combustion gas prior to its induction into the combustion chamber 34 (on the induction stroke). These scavenging means include a sealed crankcase 50 associated with each of pistons 30. In addition, holding tank 16 encloses a holding chamber 16*a* which is utilized for purposes of periodically and cyclically storing the compressed gas prior to its induction, as will be described later.

Referring to FIG. 1, sealed crankcase 50 is generally cylinderical, having the same interior contour as that of crankshaft 51. The top portion of sealed crankcase 50 communicates with the cylinder 31 and is partially enclosed by the piston 30. The crankshaft 51 extends laterally along the crankcase 50 to the ends of the crankcase 50 were sealing and bearing support means are provided for forming a sealed compression chamber bounded by the walls of crankcase 50 and piston 30. Thus, as the piston 30 reciprocates in cylinder 31, the volume of the chamber formed beneath piston 30 by the sealed crankcase 50 varies.

It is the purpose of sealed crankcase 50 to provide a compression chamber for precompressing the combustion air prior to its induction into cylinder combustion chamber 34. To provide means for inducting and discharging air from sealed crankcase 50, pressure operated one-way valves 4 and 40 are utilized in combination with an air intake manifold 60 and holding tank 16. Referring to FIG. 1, air which is to be utilized in the combustion process within the engine 1 enters the engine through air inlet manifold 60. It passes from air inlet manifold 60 into sealed crankcase 50 through a one-way crankcase intake valve 4 on the compression stroke of piston 30. The gas then undergoes compression in the crankcase 50 on the power stroke of the piston 30. As this gas is compressed in the crankcase 50, it is expelled out crankcase exhaust valve 40 into holding tank 16. This induction and compression cycle is repeated on the exhaust and induction stroke of piston 30.

Figure 3:
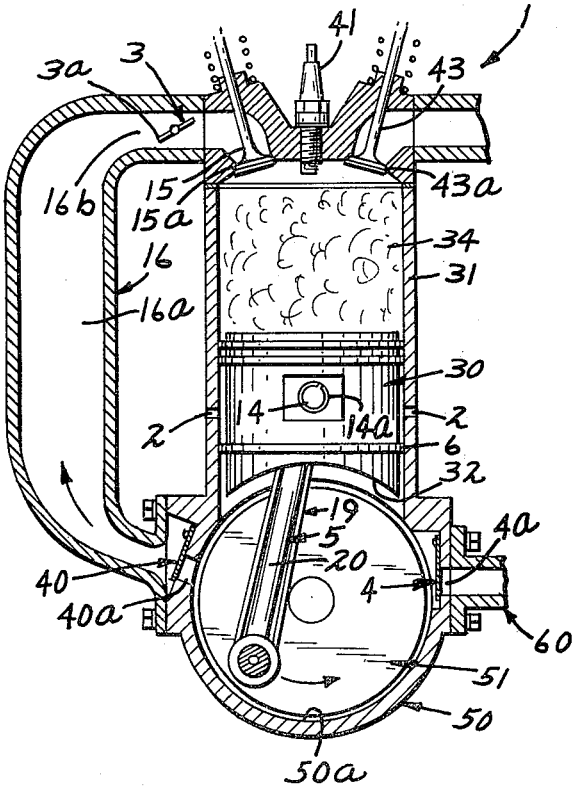
FIG. 3 is a side sectional view of the engine showing the piston during the power stroke.
Figure 4:
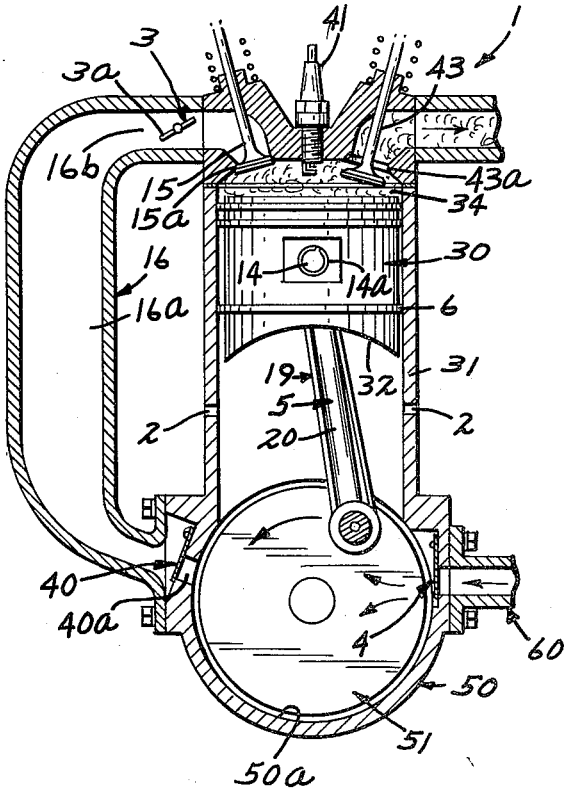
FIG. 4 is a side sectional view of the engine showing the piston on its exhaust stroke.

The induction and compression of the combustion air which is drawn into sealed crankcase 50 can be described in detail as follows. On the compression stroke of piston 30 (FIG. 2), crankcase intake valve 4 is automatically opened by the pressure drop in crankcase 50 while crankcase exhaust valve 40 is automatically closed. As a result, as piston 30 moves upwardly on its compression stroke, a vacuum is created beneath the piston 30 and air is drawn in through air intake manifold 60 and crankcase intake valve 4. When piston 30 reaches the end of its compression stroke, it begins to move downwardly on the power stroke (FIG. 3). This causes an increase in the pressure in crankcase 50 which automatically closes the one-way crankcase intake valve 4 and opens the one-way crankcase exhaust valve 40. Thus, the gas which was drawn into crankcase 50 on the compression stroke of piston 30, is now pressurized and expelled into holding tank 16. On the exhaust stroke of piston 30 (FIG. 4) a vacuum is again drawn in crankcase 50 as the piston moves upwardly in cylinder 31. Again, the vacuum force in crankcase 50 automatically opens the one-way crankcase intake valve 4 and closes the one-way crankcase exhaust valve 40. Air is drawn into crankcase 50 through manifold 60 from the carburetor (not shown). When the piston 30 reaches the top of its exhaust stroke, it again changes direction and begins moving downwardly. This opens the crankcase exhaust valve 40 and closes the crankcase intake valve 4. As the piston moves downwardly on the induction stroke (FIG. 1), the inducted air is pressurized and forced from crankcase 50 into holding tank 16, with some of the air in holding tank 16 simultaneously moving into combustion chamber 34. Thus, it can be seen that for each power stroke of engine 1, there are two compression strokes for the air which is inducted into crankcase 50. This results in an accumulation of pressurized combustion air in holding tank 16 on the power stroke of piston 30 and a forced induction of compressed air from holding tank 16 into combustion chamber 34 on the induction stroke of engine 1.

It is the purpose of this supercharging or scavenging apparatus to provide a supply of pressurized combustion air in holding tank 16 and to forcibly inject the air into combustion chamber 34. The store of gas in chamber 16 is subsequently forced into the combustion chamber 34 at a pressure above atmospheric pressure by means which will be described in detail later. Unlike conventional internal combustion engines, because the combustion air is first pressurized before its forced induction into combustion chamber 34, it has a higher temperature and has a higher density of fuel-air mixture per unit volume. In addition, because there is a positive pressure buildup between the holding tank 16 and combustion chamber 34, in the limited time during which the combustion chamber intake valve 15 is open, a larger amount of combustion gas can be drawn into the combustion chamber 34. As a result, a more advantageous burning of the fuel and air mixture occurs on the power stroke of engine 1 and greater power output is achieved.

As described above, the holding tank 16 is utilized to store the gas which is moved from crankcase 50 on the induction and power strokes of piston 30. If two of engines 1 were placed in an opposed position utilizing the same crankcase combustion chamber 51, the holding tank 16 would be a mere conduit or manifold and not a true holding tank. This results because the piston 30 in each of the opposed engines would be at the same location in its cylinder at the same time but the engine would be at different strokes. In one of the cylinders, the piston would be on the induction stroke while in the opposite cylinder the piston would be on the power stroke. Similarly, when one of the opposed cylinders is in the exhaust stroke, the opposed cylinder would be in the compression stroke. In a situation where several pairs of the engine 1 are positioned on an in-line position, the pistons would again be at relatively the same position in each cylinder, but would be at opposite strokes. When one piston was in the exhaust stroke, the other piston would be in the compression stroke and when one piston was in the induction stroke the other piston would be in the power stroke. In the case of these multiple arrangements of engine 1, be it either in an in-line or an opposed arrangement, the combustion air which is compressed in the crankcase compression chamber 50 is not stored in the chamber 16 during alternate strokes, but is continuually moved into one of the pairs of cylinders.

The present invention can be utilized with various means and methods for adding fuel to the combustion air and for carbureting the engine. In the preferred embodiment shown in FIG. 1, the fuel is added to the combustion air at a point upstream of the manifold 60 (not shown). Thus, the air which passes through air intake manifold 60 is a mixture of air and fuel. An atomizing screen 7 has been provided in air intake manifold 60 (FIG. 1) to finely atomize the fuel for mixture with the combustion air. Because the fuel can be added to the combustion air at any point, either before it enters crankcase 50, in holding tank 16 or in combustion chamber 34, whenever reference is made to "combustion air", the term may also refer to a mixture of fuel and air.

The combustion air contained in holding tank 16 enters combustion chamber 34 on the induction stroke of engine 1 (FIG. 1). Two valve means are provided between holding tank 16 and combustion chamber 34 to regulate the flow of the compressed gas into combustion chamber 34. A standard combustion chamber intake valve 15 is provided which operates off a rocker arm mechanism 42. This intake valve mechanism is similar to that found on conventional internal combustion engines wherein the timing of the valve opening is synchronized with a firing cycle. The second valve means is a throttle valve 3 which is located between holding tank 16 and the combustion chamber intake valve port 15*a*. It is the purpose of throttle valve 3 to regulate the flow of compressed combustion air from holding tank 16 into combustion chamber 34 when the automatic intake valve 15 is open. Since the throttle valve 3 is located very near the intake valve 15, there is very little residual gas which enters the combustion chamber 34 once the throttle 3 has been closed. This provides instantaneous control of the combustion air which enters the combustion chamber 34 and thus provides instantaneous control for the speed and operation of the engine 1.

As was noted earlier, crankcase intake valve 4 and exhaust valve 40 are each one-way valves which restrict intake valve port 4*a* and exhaust valve port 40*a*, respectively. They may be reed valves or other one-way valves. The use of a simple pressure controlled one-way valve in these two locations allows the valve to open and close automatically in response to pressure changes in crankcase 50. Thus, the operation of valves 4 and 40 are always synchronized with the motion of piston 30 and additional timing mechanisms are not necessary to control these valves. In addition, the simplicity of valves 4 and 40 reduce the likelihood of breakdown or necessary repair.

The combustion chamber intake and exhaust valves 15 and 43 each restrict an intake port 15*a* and exhaust port 43*a*, respectively. These valves and ports may have various designs depending on the exact nature of the cylinder design. A standard rocker arm assembly 42 can be utilized for controlling the opening and closing of these valves. In the embodiment shown in FIG. 1, a spark plug 41 is utilized for igniting the gas mixture in combustion chamber 34 to produce the power stroke for the engine. Other means of ignition may also be utilized where appropriate.

Figure 9:
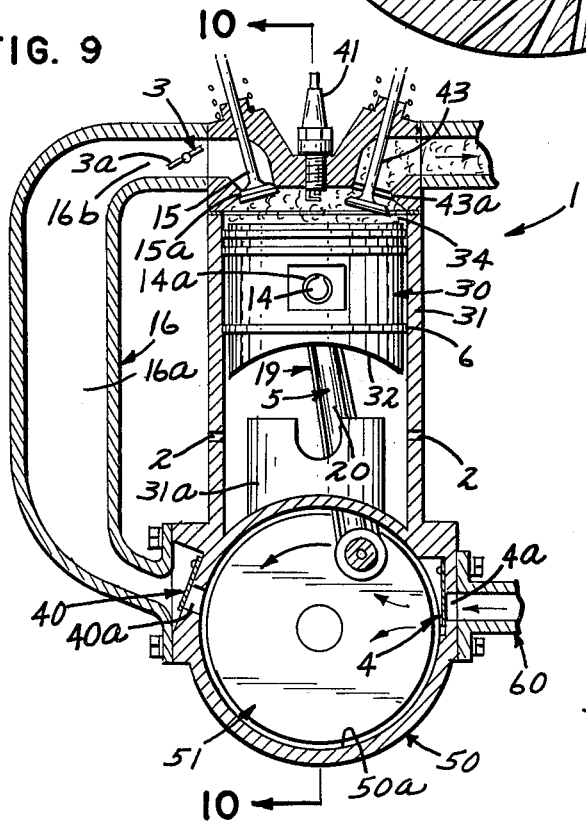
FIG. 9 is a side sectional view of the engine showing the volume take-up blocks.
Figure 10:
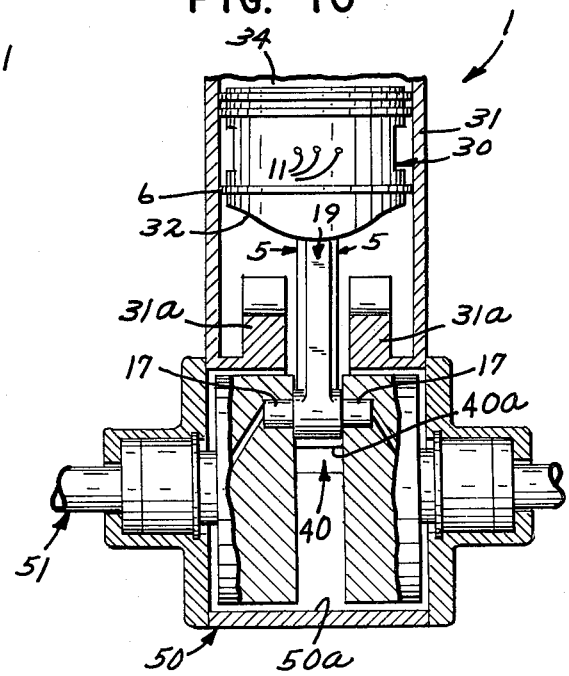
FIG. 10 is a front sectional view of the engine showing the volume take-up blocks and connection of the connecting rod to crankshaft.

Since the crankcase 50 is a sealed crankcase which is utilized as a compression chamber for supercharging the combustion air, the present invention utilizes various devices for producing a very effective crankcase compression chamber 50. In particular, referring to FIG. 1, the interior crankcase surface 50*a* has been contoured to closely fit the crankshaft 51. In addition, crankshaft 51 is generally cylindrical and extends laterally to the end (not shown) of the sealed crankcase portion 50. As a result, the amount of open space in the crankcase 50 is reduced so that the motion of piston 30 produces a higher compression in the crankcase chamber 50. In addition, the bottom surface 32 of piston 30 is shaped to match the contour of crankshaft 51 in those portions of the piston where it is adjacent to crankshaft 51. The connecting rod 19 attaches to piston 30 by means of a wrist pin 14 (see FIG. 6). An indentation (not shown) is provided along the centerline of piston 30 so that the connecting rod 19 can move freely as the piston 30 reciprocates. The volume of the indentation in piston 30 for connecting rod 19 has been minimized to again provide a smaller volume to increase the pressure which is achieved when piston 30 moves downwardly to compress the gas in crankcase 50. This can be achieved by utilizing volume takeup blocks, each designated by the numeral 31*a* (see: FIGS. 9–10), within the cylinder 31 under piston 30 which partially occupies the indentation within piston 30 in which the connecting rod oscillates. This reduces the open volume of the indentation and thus the volume of the piston is reduced, reducing the volume within crankcase 50. As a result, the combustion air drawn into the crankcase 50 is compressed to a higher pressure by movement of the piston 30.

Figure 5:
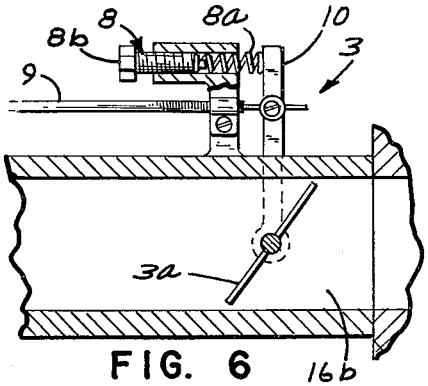
FIG. 5 is a detailed sectional view showing the throttle assembly.

FIG. 5 shows the throttle valve 3 in detail. The valve 3 has a valve plate 3*a* which is located within passageway 16*b* which communicates between holding tank 16 and intake valve port 15*a*. A throttle cable 9 attached to a throttle arm 10 to vary the angle at which throttle valve plate 3*a* is positioned to thereby vary the open space through which combustion gas can flow from holding tank 16 into intake valve 15. Throttle arm 10 and cable 9 are located in the outside of passageway structure 16*b*. An idle-adjustment screw mechanism 8 is provided for holding the throttle valve 3 in a partially open position when the engine is idling. The idle screw mechanism 8 consists of a spring 8*a* which bears against throttle arm 10 and a set screw 8*b*. Spring 8*a* keeps throttle arm 10 in a biased, partially open idle position when no force is exerted on throttle arm 10. Set screw 8*b* positions biasing spring 8*a* at a selected, partially open idle position. To completely close the throttle plate 3*a*, a positive push or pull force is exerted on the push-pull throttle cable 10 to overcome the bias of spring 8*a*, thus moving the plate 3*a* to a totally closed position.

Unlike most engines, wherein throttling occurs at or near the carburetor location, in the present invention the throttle valve 3 is located very near the intake valve port 15*a* for combustion chamber 34. This allows instantaneous control of the running of engine 1. The close proximity of throttle valve 3 to combustion chamber 34 eliminates the presence of residual gases which would have to be burned following activation of the throttle valve before the engine would actually respond to the actuation of the throttle valve.

To lubricate the peripheral surface of piston 30 in cylinder 31, the present invention provides alternative lubrication means. In one embodiment shown in FIG. 1, oil holes 2 are provided in the wall of cylinder 31 to be utilized in combination with an oil supply means (not shown) to supply oil directly to the interior surface of cylinder 31 at the main points of wear. There may be any number of holes 2 for this purpose. When oil holes 2 are utilized, only one oil lift tube 20, to be described in detail later, would be necessary to lubricate the wrist pin 14 of piston 30. The present invention may also utilize lubrication means wherein oil is added to the gas to lubricate the interior walls of the cylinder 31 and the wrist pin 14. This lubrication would occur when the oil entered valve 4 as a vapor and was conveyed to the interior surfaces of the engine 1. However, this method of lubricating the engine 1 would be more costly because of the amount of oil which would be necessary and because of the difficulties encountered in mixing oil with fuel.

Figure 7:
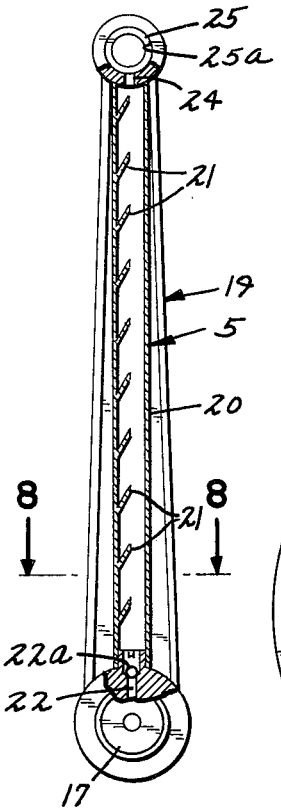
FIG. 7 is a detailed side view of the connecting rod showing the oiling lift tubes in cross section.
Figure 6:
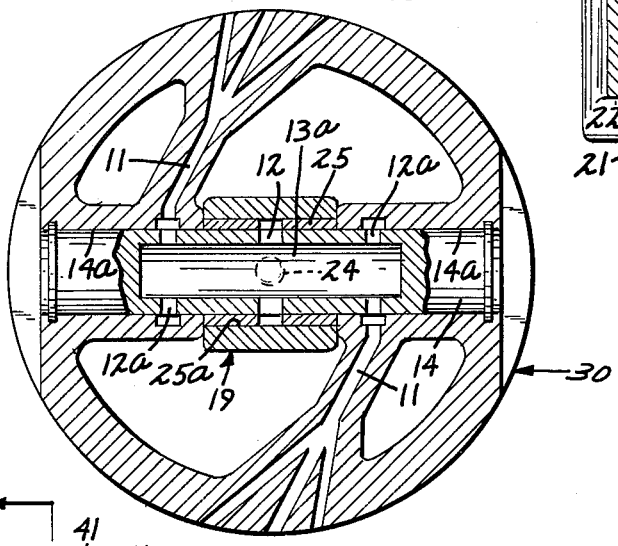
FIG. 6 is a top sectional view of the piston showing the lubricating channels.
Figure 8:
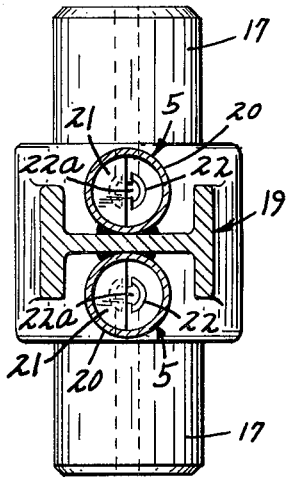
FIG. 8 is a top sectional view of the connecting rod of FIG. 7 taken along the line 8—8.

In the embodiment shown in FIGS. 6 and 7, lubricating means 5 are provided for supplying oil from the crankshaft 51 to the wrist pin 14 and piston 30. In conventional internal combustion engines where the crankcase is not utilized as a compression chamber, oil is splashed from the crankshaft up to the interior walls of the cylinder and wrist pin. In addition, in conventional engines, oil supply means are provided to lubricate the rocker arm assembly of the engine (such as rocker arm assembly 42) and these means are typically connected with the crankcase lubrication means. In the present invention, the crankcase 50 must be utilized as a compression chamber and thus it is preferrable that the oil be carried to cylinder 30 from crankshaft 51 through the internal conduit system so that the oil is not subject to evaporation and heat in crankcase 50. Such an internal conduit system is a part of lubricating means 5. A separate oiling system (not shown) is used for rocker arms 42. In addition, a separate chamber (not shown) is used for lubricating gears and pumps and to pump oil into the crankshaft for lubricating the crankshaft bearings.

Referring to FIG. 7, the present lubricating means 5 utilize two oil lift tubes, each designated by the numeral 10, attached to the exterior surface of connecting rod 19. Oil is carried to the connecting rod 19 from a source of oil (not shown) through crankshaft 51 and along connecting rod bearing 17. From connecting rod bearing 17, the oil flows through a lower oil port 22 in connecting rod 19 and up through the lift tube 20. The oil lift tubes 20 would have a one-way valve at their lower port 22, as will be described in detail later.

In the embodiment shown in FIG. 1, the connecting rod 19 is attached to piston 30 by means of a wrist pin 14 which is supported by bearing 25 located in opening 25*a* of the connecting rod 19. The wrist pin 14 extends through an opening 14*a* in piston 30 to interconnect the connecting rod 19 to the piston 30. In the lubricating system 5 of FIG. 7, the oil passes out of lift tubes 20 through an upper oil port 24 to the area surrounding wrist pin 14. The oil then passes through a hole 12 in wrist pin 14 to an interior channel 13*a* within wrist pin 14. From channel 13*a*, the oil flows through two holes 12*a* located at either end of channel 13*a*. The holes 12*a* are positioned to communicate with oil passageway means 11 contained in piston 30. As is shown in FIG. 6, the oil passageways 11 in piston 30 extend from the wrist pin opening 14*a* to the outer periphery of the piston 30. In this way, the oil flows from the wrist pin 14 through oil channels 11 to the periphery of the piston 30 for lubricating that area of the piston.

The oil which is carried to the periphery of piston 30, tends naturely to flow downwardly along the exterior surface of piston 30. A lower oil ring 6 positioned at the bottom portion of piston 30, is utilized to keep the oil from flowing past this point to the area beneath the piston 30 and into crankcase 50. Thus, the oil which is carried to the piston periphery through the oil means 5 is kept from entering the crankcase 51 by the lower oil ring 6 on piston 30. As a result, very little of the lubricating oil enters the crankcase 50 and what does enter is evaporated with the gas or air and is burned. In certain instances, a lower oil ring would not be necessary.

To propel the oil from the lower oil channel 22 to the upper oil channel 24 in connecting rod 19, it may be necessary to utilize cascade riffles 21 positioned in lift tube 20. It is the purpose of riffles 21 to sequentially splash the oil up the interior of lift tube 20 by a cascading action as the connecting rod 19 continually reciprocates. In this way, an effective lubricating means is provided for a crankcase scavenged internal combustion engine which utilizes the crankcase as a compression chamber for precompressing the combustion gas.

The oil which is propelled through lubricating means 5 is supplied by pressurized means which pump oil from an oil source (not shown) into the crankshaft 51. This oil enters the lift tubes 20 of connecting rod 19 through an opening 22 adjacent to the bearing (not shown) which supports the connecting rod 19 on the crankshaft 51. A one-way valve 22*a* is positioned in opening 22 to allow oil to flow up into lift tubes 20 and prevent oil from flowing out of lift tubes 20 through opening 22. The one-way valve 22*a* operates automatically as the connecting rod 19 moves up and down. Because of the reciprocating movement of connecting rod 19, a centrifugal force is produced which automatically opens and closes the one-way valve 22*a*. In operation, the combined effect of one-way valve 22*a* and oil lift tube 20 provides means for filling the oil lift tubes 20 with oil once the engine is running. A combination of pressure forces and capillary forces then tends to move the oil through the various passageways in connecting rod 19 and piston 30 to move the oil from the lift tubes 20 to the periphery of piston 30. Because the various channels and passageways are relatively small in dimension, and because the forces which tend to move the oil up the lift tube 20 and through the various passage ways are small the amount of oil which flows up to the periphery of piston 30 is relatively small. Consequently, the oil which finds its way to the periphery of piston 30 can be kept in that location by the lower ring 6 on piston 30 and the small amount of oil which enters the crankcase would be evaporated and burned up.

The present invention produces a high efficiency operation because of its supercharging apparatus. In addition, the particular throttle mechanism provides instantaneous control of the engine. An improved lubricating means has been provided for lubricating the exterior surface of the engine piston. The engine could find particular usefulness in airplane motors, motorcycles and the like. The individual piston-cylinder apparatus 1 may be combined in various combinations. For instance, the total engine may consist of pistons which are in opposed pairs (i.e. 4, 6, 8, etc. in-line cylinders) or vertical twins.

The crankshaft 51 is balanced, wherever necessary by boring holes into the crankshaft 51 in a particular pattern which properly balances the crankshaft. Since it is important that the open volume of the crankcase chamber 50 be minimized to increase the pressure which is produced on the down stroke of piston 30, the balancing holes (not shown) which are placed in crankshaft 51 must be filled with a lightweight material or sealed (not shown) to eliminate the open volume of such holes or openings.

What is claimed is:

1. Improved internal combustion engine apparatus for driving a power shaft, comprising:

a. a cylinder with a combustion chamber which has controlled intake and exhaust valves;

b. a crankcase positioned adjacent said cylinder and enclosing a crankcase chamber which has a generally cylindrical shape, said crankcase and said cylinder being interconnected to form a generally sealed compression chamber for precompressing combustion air for use in the engine;

c. a crankshaft mounted in said crankcase for rotation, said crankshaft connected to a power shaft and having an exterior surface contour which essentially matches the contour of said crankcase chamber interior surface to reduce the unoccupied volume of said crankcase;

d. a piston slidably and sealably mounted within said cylinder for reciprocal movement, said piston having a top and bottom and serving as a moving barrier between said cylinder combustion chamber and said crankcase chamber, said piston creating an above atmospheric pressure in said crankcase chamber on its down-stroke and a below atmospheric pressure on its up-stroke;

e. a connecting rod interconnecting said piston and said crankshaft for transmitting the reciprocal movement of said piston to a rotary movement of the crankshaft;

f. a communication chamber communicating with said cylinder intake valve and said crankcase for containing combustion gases which are pressurized above atmospheric pressure in said crankcase chamber by movement of said piston;

g. said crankcase chamber containing:

i. a one-way intake valve positioned between said crankcase chamber and a source of combustion air, said crankcase intake valve openable automatically when the pressure in said crankcase chamber is below atmospheric pressure and closable automatically when said pressure is at or above atomospheric pressure; and ii. a one-way exhaust valve interrupting the communication between said crankcase chamber and said communication chamber, said crankcase exhaust valve openable automatically when the pressure in said crankcase chamber is above the pressure in said communication chamber and closable automatically when said pressure is at or below the pressure in said communication chamber, said automatic crankcase valves serving to regulate the flow of combustion air to said crankcase in response to the movement of said piston to precompress combustion air for movement to said communication chamber;

h. fuel additive means for adding fuel to the combusion air which enters said cylinder combustion chamber;

i. ignition means for selectively igniting the fuel mixture which is present in said cylinder combustion chamber; and j. piston lubrication means for carrying lubrication oil from an oil source through said piston rod to the periphery of said piston, said piston lubrication means comprising:

i. means for distributing lubricating oil from an oil source to said connecting road at the point where said connecting rod connects with the crankshaft;

ii. said connecting rod containing at least one oil lift tube communicating between said oil distribution means and said piston, said lift tube defined in part by an interior surface and including a plurality of riffles positioned along the interior surface of said lift tube to cascade the oil upwardly through said lift tube in response to cyclic motion of said connecting rod, each of said riffles only partially spaning the distance between opposite portions of said interior surface to provide room for the moving oil to cascade past successive riffles from one to another;

iii. said piston containing a plurality of passageways communicating between said piston rod lift tube and the exterior surface of said piston for carrying oil therethrough to lubricate said piston surface; and iv. a one-way valve positioned in said oil lift tube, said valve opening and closing in response to movement of said piston rod to meter the flow of oil from said distribution means to said lift tube while preventing the back flow of oil from said lift tube through said one-way valve.

2. Improved internal combustion engine apparatus for driving a power shaft, comprising:

a. a cylinder with a combustion chamber which has controlled intake and exhaust valves;

b. a crankcase positioned adjacent said cylinder and enclosing a crankcase chamber which has a generally cylindrical shape, said crankcase and said cylinder being interconnected to form a generally sealed compression chamber for precompressing combustion air for use in the engine;

c. a crankshaft mounted in said crankcase for rotation, said crankshaft connected to a power shaft and having an exterior surface contour which essentially matches the contour of said crankcase chamber interior surface to reduce the unoccupied volume of said crankcase;

d. a piston slidably and sealably mounted within said cylinder for reciprocal movement, said piston having a top and bottom and serving as a moving barrier between said cylinder combustion chamber and said crankcase chamber, said piston creating an above atmospheric pressure in said crankcase chamber on its down-stroke and a below atmospheric pressure on its up-stroke;

e. a connecting rod interconnecting said piston and said crankshaft for transmitting the reciprocal movement of said piston to a rotary movement of the crankshaft;

f. at least one volume take-up member fixedly positioned within said cylinder, said volume take-up member being sized and positioned to occupy an open indentation which may be present in the bottom of said piston to accommodate said connecting rod, said take-up member thereby reducing the unoccupied volume of said cylinder when said piston has moved through its down stroke to increase compression therebeneath;

g. a communication chamber communicating with said cylinder intake valve and said crankcase for containing combustion gases which are pressurized above atmospheric pressure in said crankcase chamber by movement of said piston;

h. said crankcase chamber containing;

i. a one-way intake valve positioned between said crankcase chamber and a source of combustion air, said crankcase intake valve openable automatically when the pressure in said crankcase chamber is below atmospheric pressure and closable automatically when said pressure is at or above atmospheric pressure; and ii. a one-way exhaust valve interrupting the communication between said crankcase chamber and said communication chamber, said crankcase exhaust valve openable automatically when the pressure in said crankcase chamber is above the pressure in said communication chamber and closable automatically when said pressure is at or below the pressure in said communication chamber, said automatic crankcase valves serving to regulate the flow of combustion air to said crankcase in response to the movement of said piston to precompress combustion air for movement to said communication chamber;

i. fuel additive means for adding fuel to the combustion air which enters said cylinder combustion chamber;

j. ignition means for selectively igniting the fuel mixture which is present in said cylinder combustion chamber; and k. piston lubrication means for carrying lubrication oil from an oil source through said piston rod to the periphery of said piston, said piston lubrication means comprising:

i. means for distributing lubricating oil from an oil source to said connecting road at the point where said connecting rod connects with the crankshaft;

ii. said connecting rod containing at least one oil lift tube communicating between said oil distribution means and said piston, said lift tube defined in part by an interior surface and including a plurality of riffles positioned along the interior surface of said lift tube to cascade the oil upwardly through said lift tube in response to cyclic motion of said connecting rod, each of said riffles only partially spaning the distance between opposite portions of said interior surface to provide room for the moving oil to cascade past successive riffles from one to another;

iii. said piston containing a plurality of passageways communicating between said piston rod lift tube and the exterior surface of said piston for carrying oil therethrough to lubricate said piston surface; and iv. a one-way valve positioned in said oil lift tube, said valve opening and closing in response to movement of said piston rod to meter the flow of oil from said distribution means to said lift tube while preventing the back flow of oil from said lift tube through said one-way valve.

3. The engine apparatus of claim 2, including throttle valve means positioned between said holding chamber and said cylinder intake valve to selectively regulate the flow of pre-compressed combustion air which passes through said cylinder intake valve.

* * * * *